US008585351B2

(12) United States Patent
Bregman et al.

(10) Patent No.: US 8,585,351 B2
(45) Date of Patent: Nov. 19, 2013

(54) GAS TURBINE BLADE

(75) Inventors: Vitaly Bregman, Moskau (RU); Mikhail Petukhovskiy, Moscow (RU)

(73) Assignee: OOO Siemens, Moscow (RU)

( * ) Notice: Subject to any disclaimer, the term of this patent is extended or adjusted under 35 U.S.C. 154(b) by 0 days.

(21) Appl. No.: 13/806,196

(22) PCT Filed: Jun. 1, 2011

(86) PCT No.: PCT/EP2011/059057

§ 371 (c)(1), (2), (4) Date: Jan. 24, 2013

(87) PCT Pub. No.: WO2011/160930

PCT Pub. Date: Dec. 29, 2011

(65) Prior Publication Data

US 2013/0216395 A1 Aug. 22, 2013

(30) Foreign Application Priority Data

Jun. 23, 2010 (WO) ..... PCT/RU2010/000351

(51) Int. Cl.
*F01D 5/18* (2006.01)

(52) U.S. Cl.
USPC ..... 415/115; 416/97 R

(58) Field of Classification Search
USPC ..... 416/96 R, 97 R, 92, 90; 415/115
See application file for complete search history.

(56) References Cited

U.S. PATENT DOCUMENTS

| | | | | |
|---|---|---|---|---|
| 3,527,543 | A | 9/1970 | Howald | |
| 5,192,192 | A | 3/1993 | Ourhaan | |
| 6,923,623 | B2 * | 8/2005 | Cleveland et al. | 416/97 R |
| 7,097,419 | B2 * | 8/2006 | Lee et al. | 415/115 |

FOREIGN PATENT DOCUMENTS

| | | | |
|---|---|---|---|
| EP | 1059419 | A1 | 12/2000 |
| EP | 1270873 | A2 | 1/2003 |
| EP | 1505255 | A2 | 2/2005 |
| EP | 1927727 | A2 | 6/2008 |

* cited by examiner

*Primary Examiner* — Dwayne J White

(57) ABSTRACT

A gas turbine blade including a root, an airfoil with a leading edge and a trailing edge, a radial outer tip, and a pressure side and a suction side between the leading edge and the trailing edge, and a cooling air channel system extending from an air inlet opening in the root throughout the airfoil to a plurality of air outlets at the pressure side and the leading edge of the top of the tip of the airfoil.

13 Claims, 2 Drawing Sheets

FIG 2
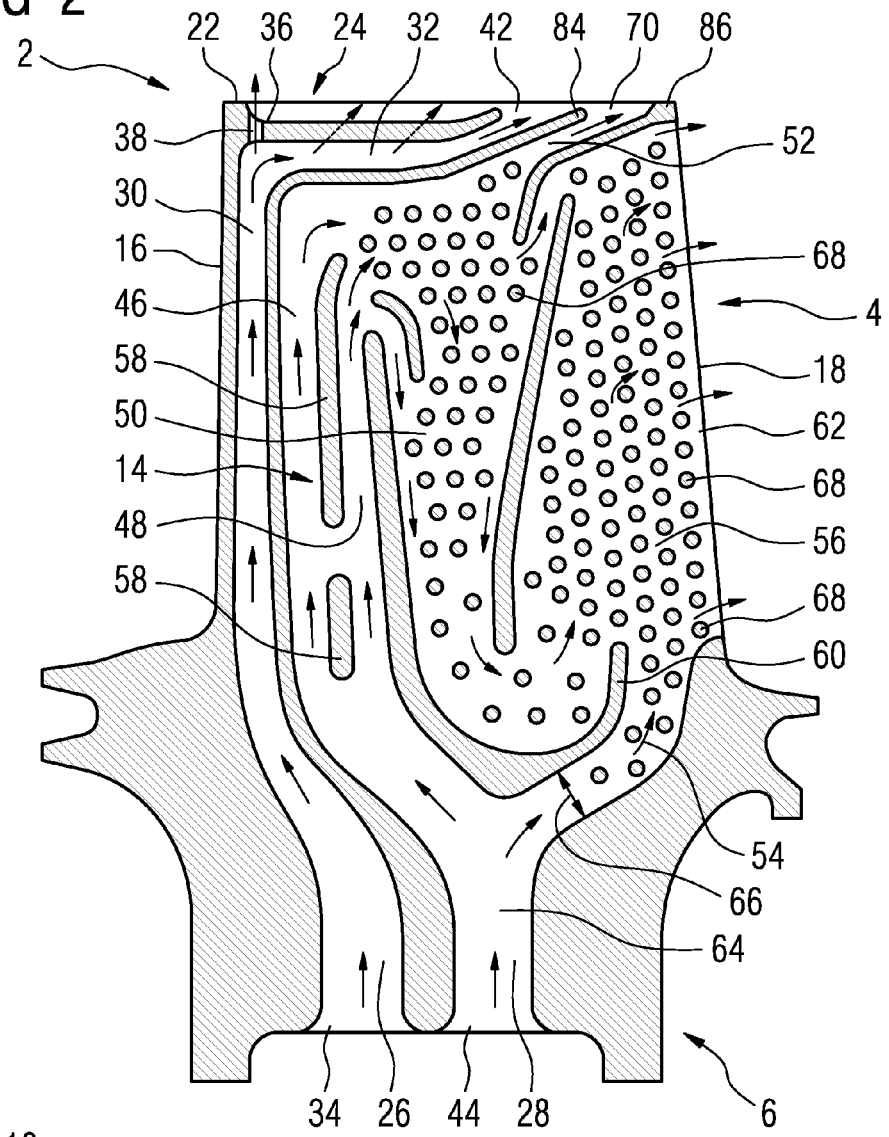
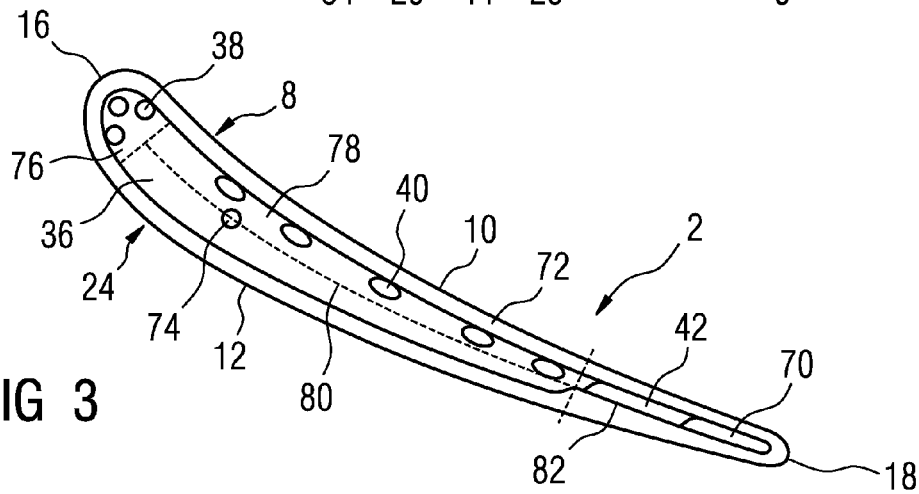
FIG 3

GAS TURBINE BLADE

CROSS REFERENCE TO RELATED APPLICATIONS

This application is the US National Stage of International Application No. PCT/EP2011/059057, filed Jun. 1, 2011 and claims the benefit thereof The International Application claims the benefits of International application No. PCT/RU2010/000351 WO filed Jun. 23, 2010. All of the applications are incorporated by reference herein in their entirety.

FIELD OF INVENTION

This invention is directed generally to a gas turbine blade comprising a root, an airfoil with a leading edge, a trailing edge, a radial outer tip, and a pressure side and a suction side between the leading edge and the trailing edge, and a cooling air channel system extending from an air inlet opening in the root throughout the airfoil to a plurality of air outlets at the pressure side and the leading edge of the top of the tip of the airfoil.

BACKGROUND OF THE INVENTION

Gas turbines operate at high temperatures that may reach 1.200° C. and more. Accordingly the turbine blades must be capable of withstanding such high temperatures. For prolonging the life of the blades they often contain cooling systems conducting cooling air through the blade.

A gas turbine blade comprises a root, a platform and an airfoil that extends outwardly from the platform, the airfoil comprising a tip, a leading edge and a trailing edge. During operation of a gas turbine high stresses may be generated in some areas of the turbine blade. Particular life limiting areas are found in the airfoil hub region and the trailing edge region at the hub forming a relatively thin wall on the downstream side of the airfoil. Because of its relatively thin structure and high stresses during operation, the trailing edge is highly susceptible to formation of cracks which may lead to failure of the airfoil.

The cooling system contains internal cooling channels which receive air from the compressor of the gas turbine and pass the air through the blade. The cooling channels include multiple flow paths that are designed to maintain the turbine blade at a relatively uniform temperature. However, centrifugal forces and air flow at boundary layers sometimes prevent some areas of the turbine blade from being adequately cooled, resulting in the formation of localized hot spots which can reduce the lifetime of a turbine blade.

A cooling system in the airfoil may include cooling air passages to maximize convection cooling in the airfoil tip and trailing edge, and discharge a portion of the cooling air through cooling holes in the tip and trailing edge of the airfoil. Such turbine blade is known, for instance, from U.S. Pat. No. 5,192,192.

SUMMARY OF THE INVENTION

It is an object of the invention to provide a gas turbine blade with a high cooling capability in the tip of the airfoil.

This object is solved in accordance with the invention by a gas turbine blade as mentioned above, wherein the concentration of air outlets at the top of the tip of the airfoil is higher on the pressure side than on the suction side. With this measure the cooling air or any other cooling fluid is lead more precise to such parts of the tip where the most heat is generated during operation of the blade. Since less or no air is lead to the suction side of the top of the tip most or all cooling air is allocated for cooling the heated pressure side of the top of the tip.

The concentration of the air outlets may be measured in outlet cross section per area tip surface, or—if there are numerous outlets of the same cross section—in numbers of outlets per surface area of the tip. Preferably the suction side of the top of the tip is free from air outlets.

The top of the tip may be defined as the part of the tip facing radially outward. The pressure side may be defined as pressure side section of the top of the tip and the leading edge may be defined as leading edge section of the top of the tip. The pressure side section and suction side section, called pressure side and suction side for convenience, may be defined as areas of the top of the tip extending from the respective outer border of the tip to the skeleton line of the tip or a line in the middle between the pressure side wall and the suction side wall.

The leading edge of the tip may be defined by the area within ±90° measured from the skeleton line at the point where it cuts through the upstream surface or pressure side surface of the airfoil. Depending on the type of blade, another definition is the area extending from the leading edge of the airfoil in a distance towards the trailing edge which could be 1/10 of the distance between the leading edge and the trailing edge.

The top of the tip of the blade may include one or more ribs extending from a tip floor radially outward. Such rib or ribs may extend from the leading edge to the trailing edge or over a part of that distance, two ribs forming a cavity or chamber in between. Such rib or ribs serve a sealing means for reducing leakage gases flowing between the tip of the blade and a stationary outer seal which circumferences a row of blades. Preferably the cooling air outlets are located inside of a rib elongating the pressure side wall of the airfoil radially outwards from the tip floor. Preferably a rib runs in a bow around the leading edge of the tip, the air outlets located on the leading edge being surrounded by the bow of this rib.

In accordance with an aspect of the invention the number of air outlets per area near the leading edge of the tip, especially in a leading edge section, is higher than the average number of air outlets per area in the top of the tip. The hot spot of the leading edge of the tip may be cooled in most efficient manner combined with very efficient use of little cooling air. Preferably the concentration of air outlets on the leading edge is higher than at the highest outlet concentration on the pressure side. Advantageously the medium distance between neighbouring air outlets on the leading edge is higher than the medium distance between neighbouring air outlets on the pressure side of the tip. With this cooling air may be distributed very equally throughout the leading edge section of the tip.

In a preferred embodiment of the invention the air outlets at the leading edge form a group of air outlets arranged at the leading edge of the tip. With this measure the cooling air may be distributed very equally throughout the leading edge section of the tip as well.

In accordance with another aspect of the invention the shortest distance between said group and the air outlet closest to said group is larger than the diameter of said group. While the leading edge of the tip of the airfoil is a hot spot generating much heat during operation of the blade, a section of the pressure side of the airfoil close to the leading tip generates rather little heat, less heat than a following section further down in direction to the trailing edge. With this embodiment cooling air is lead only to hot regions, saving air where little heat is generated. Preferably a region free of air outlets is arranged between said group and the air outlet on the pressure side closest to said group, this region being larger in diameter in the direction from the leading edge to the trailing edge than the diameter of said group.

In accordance with a further aspect of the invention the air outlets at the pressure side of the top of the tip are arranged in a row completely inside a rib at the pressure side of the tip leaving the thickness of the rib untouched. Since the rib might be rather thin, especially in small blades, its mechanical strength is kept high without any outlet cuts.

The generation of heat is not equal in every section along the pressure side of the tip. With a cooling with respect to different heat generation along the pressure side hotter areas may be supplied with more cooling air and less hot regions with less cooling air. Accordingly, it is advantageous if the air outlets at the pressure side of the top of the tip are arranged in a row inside a rib, the distance between the air outlets in the middle between the leading edge and the trailing edge being larger than between the air outlets closer to the trailing edge.

A similar advantage is achieved, if the air outlets at the pressure side of the top of the tip are arranged in a row inside a rib, the distance between the air outlets in the middle between the leading edge and the trailing edge being larger than between the air outlets closer to the leading edge.

A further measure along with or alternative to different air outlet distribution is the setting of different cross sections of the air outlets, the outlets in hotter regions having a larger cross section than outlets in cooler regions. Specifically, the air outlets closest to the trailing edge might have a larger air cross section than the air outlets in the middle between the leading edge and the trailing edge. One particular area of high stress is found in the airfoil trailing edge, which is a portion of the airfoil forming a relatively thin edge. Therefore this region should be carefully cooled to prevent the formation of cracks which may lead to failure of the airfoil. With a larger cross section efficient cooling may be achieved.

The same is true if the air outlets at the pressure side of the top of the tip are arranged in a first section in a middle part of the tip and a second section at the trailing edge of the tip, wherein the outlets of the first section are formed different, especially as rounded holes, than the outlets of the second section, which are formed as slits preferably.

Preferably, the outlets of the second section point radially outward and are bevelled towards the trailing edge by 45° to 80° to the radial direction, especially by 68° to 72° to the radial direction.

Some blades in a high pressure region of the turbine might be as small as a few centimetres in length. Accordingly the structures of the airfoil are delicate, the most delicate region being the trailing edge and an adjacent region. An even and reliable cooling of such structures might be achieved if the tip comprises a floor and a rib above and at least partly around the floor, the outlets of the first section being holes in the floor, the floor ending on its way to the trailing edge, its end margin an outlet of the second section formed as a slit.

In a further embodiment of the invention the cooling air passage contains at least two air channel systems, the first of which running directly inside the leading edge and the second one running—preferably throughout its whole length—more distanced from the leading edge than the first one, the first channel system feeding air outlets of the first section and being separated from at least one outlet of the second section, and the second channel system feeding at least one air outlet of the second section and being separated from outlets of the first section. In the leading edge of the airfoil much heat is generated during operation of the blade, air flowing in a channel running close to the leading edge is heated to some extend. Since the trailing edge of the tip is a hot region as well, it should not only be cooled by air already heated too much on its way along the leading edge. By splitting cooling air in two channel systems one of them may direct cooling air along the leading edge for cooling the same, and cooling air in the second may be kept cool enough to still sufficiently cool the trailing edge of the tip.

If the first channel system feeds air only to outlets of the top of the tip, and the second channel system feeds air to the top of the tip and to outlets of the trailing edge between the tip and the base, both regions, the tip and the trailing edge may be cooled sufficiently and reliably.

For reliably cooling the hot region at the trailing edge of the tip it should be prevented that due to turbulences inside the blade caused by rotation of the blade cool air is prevented to reach the air outlet close to this hot region. It is proposed, therefore, that the outlet arranged closest to the trailing edge is fed only by the second channel system.

Cooling of a delicate region close to the trailing edge in sufficient manner on the pressure side as well as on the suction side may be achieved if at least one outlet of the second section extends from the pressure side wall to the suction side wall of the top of the tip. Preferably this outlet opens inside the rib, especially a rib completely surrounding the opening along the trailing edge.

BRIEF DESCRIPTION OF THE DRAWINGS

While the specification concludes with claims particularly pointing out and distinctly claiming the present invention, an embodiment of the invention will now be described, by way of example only, with reference to the accompanying drawings, wherein:

FIG. 2 shows a cross-sectional view of the turbine blade with channels for leading cooling air through the airfoil, and FIG. 3 shows a view top down on the tip of the airfoil.

Referring to FIG. 1, an exemplary turbine blade 2 for a gas turbine engine is illustrated. The blade 2 includes an airfoil 4 and a root 6 which is used to conventionally secure the blade 2 to a rotor disk of the engine for supporting the blade 2 in the working medium flow path of the turbine where working medium gases exert motive forces on the surfaces thereof. With reference to FIG. 1 and FIG. 2 the airfoil 4 has an outer wall 8 surrounding a hollow interior 14. The airfoil outer wall 8 comprises a generally concave pressure sidewall 10 and a generally convex suction sidewall 12 (FIG. 3) which are spaced apart in a widthwise direction to define the hollow interior 14 therebetween. The pressure and suction sidewalls 10, 12 extend between and are joined together at an upstream leading edge 16 and a downstream trailing edge 18. The leading and trailing edges 16, 18 are spaced axially or chordally from each other. The airfoil 4 extends radially along a longitudinal or radial direction of the blade 2, defined by a span of the airfoil 4, from a radially inner airfoil platform 20 to a radially outer blade tip surface 22 of the tip 24 of the airfoil 4.

As seen in FIG. 2, two cooling fluid channel systems 26, 28 are defined in the hollow interior 14. The cooling fluid channels systems 26, 28 extend spanwise through the turbine blade 2 and are both and separate from each other in fluid communication with a supply of cooling fluid. The cooling fluid channel systems 26, 28 both pass through the airfoil 4 and along their full length between the pressure sidewall 10 and the suction sidewall 12 to transfer heat from the surfaces of the airfoil sidewalls 10, 12 to the cooling fluid and to maintain the temperature of the blade 2 below a maximum allowable temperature.

Figure 1:
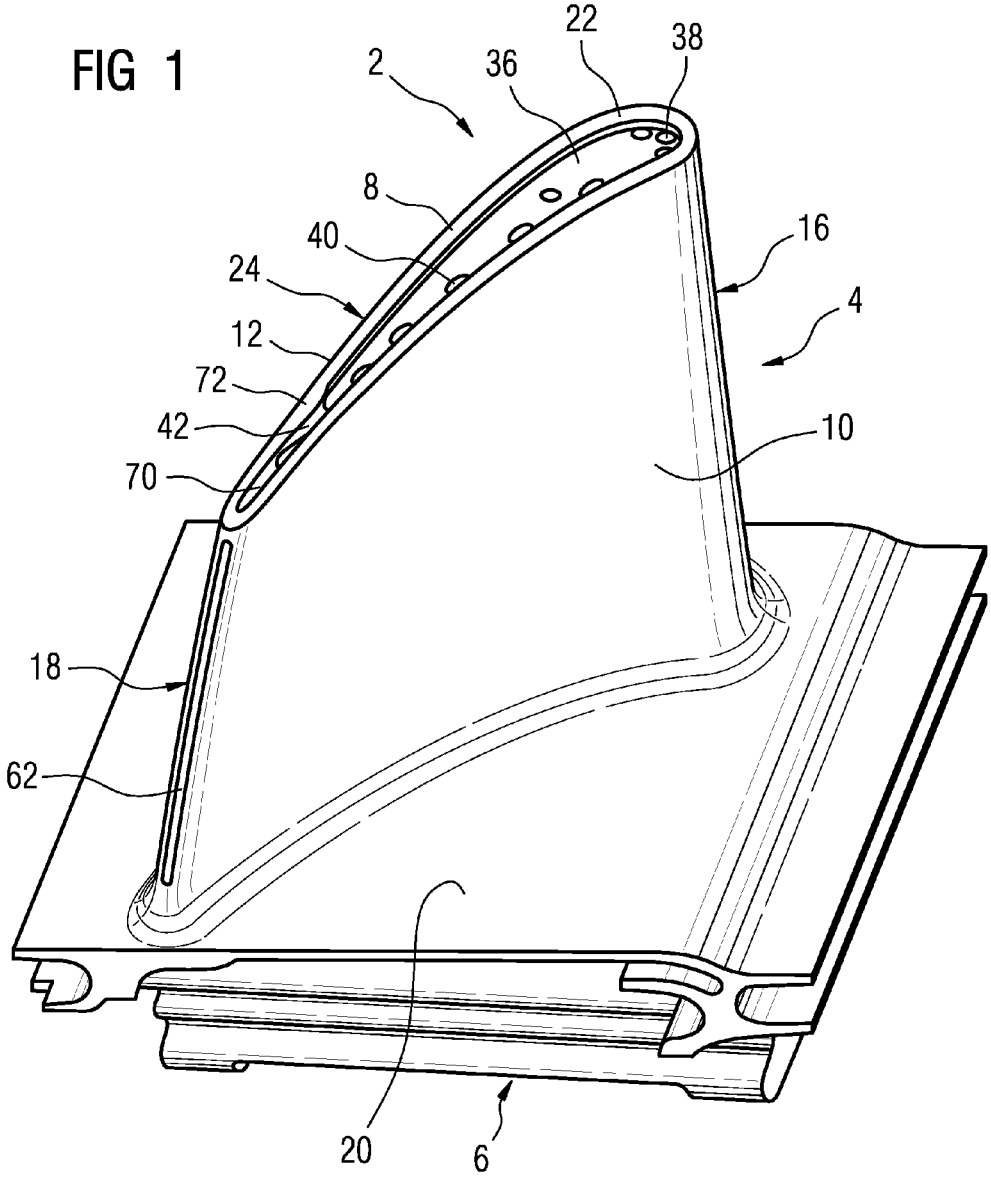
FIG. 1 shows a perspective view of a turbine blade including a root and an airfoil.

The cooling fluid channel system 26 comprises a radial channel 30 and an axial channel 32 directly following the radial channel 30 in air flow direction. The cooling fluid channel system 26 runs from an opening 34 at the radial inner end of the root 6 inside the outer wall 8 directly along the leading edge 16 directly neighbouring the leading edge 16 from the radial inner beginning of the leading edge 16 up to a tip floor 36 forming a wall parallel to the extension of the tip 24. Throughout this passage the channel system 26 is free of branches supplying all its cooling air along the leading edge 16 to the tip floor 36, and cooling the leading edge 16 very efficiently.

Along its further course the cooling fluid channel system 26, or more precise: its axial channel 32 ends in a plurality of air outlets 38, 40, 42 all arranged at the tip 24 of the airfoil 4. So, all cooling air running through the inner opening 34 into the cooling fluid channel system 26 is guided to outlets 38, 40, 42 at the top of the tip 24.

The second cooling fluid channel system 28 starts as well in an opening 44 in the radial inner end of the root 6 of the blade 2 and extends spanwise to the tip 24. However, this system 28 branches into a plurality of channels: two parallel radial channels 46, 48, a serpentine flow channel 50, a tip channel 52, a bypass channel 54, and a trailing edge channel 56. The radial channel 46 runs parallel to the leading edge channel 30 and opens into the tip channel 52 and the serpentine flow channel 50. The radial channel 48 is separated by an intercepted radial wall 58 from the radial channel 46, runs parallel to the leading edge channel 30 as well, and opens into the tip channel 52 and the serpentine flow channel 50.

The serpentine flow channel 50 begins at the end of the radial channels 46, 48 runs in two U-turns from radial outward direction to radial inward and again to radial outward, and opens into the trailing edge channel 56. The radial inner U-turn is guided by a U-turn wall 60 bordering the U-turn and turning in an angle of at least 150° from radial inward to radial outward. The trailing edge channel 56 may end in a plurality of outlets arranged in the trailing edge 18, wherein the special embodiment shown in FIG. 1 and FIG. 2 comprises only one trailing end outlet 62 formed as a radial slit and extending over 80% of the radial length of the trailing edge 18. The trailing edge channel 56 is formed like a radial passage open along its axial side to the trailing edge in the outlets, respectively the outlet 62.

The bypass channel 54 connects a root channel 64 extending from the opening 44 to the radial channels 46, 48 directly with the trailing edge channel 56 leading cooling air directly from the root channel 64 to the trailing edge channel 56. The bypass channel 54 is bent during its course from the root channel 64 to the trailing edge channel 56 opening in radial outward direction into a section of the trailing edge channel 56 which is directly situated at the outlet slit 62 of the trailing edge 18, thus opening directly to the trailing edge 18 respectively into the trailing edge air outlet 62.

The root channel 64 is located completely in the root 6 of the blade 2, thus below—which is radially inside—the platform 20. The bypass channel 64 is located with at least half of its length, especially more than ¾ of its length, below the platform 20.

For supplying the trailing edge channel 56 with sufficient cold air the most narrow channel width 66 of the bypass channel 54 is larger than half of the width of the root channel 64 from which the bypass channel 54 branches. This most narrow width is about 11% of the chord width of the airfoil, thus the length between the leading edge 16 and the trailing edge 18. In this narrowest part of the bypass channel 54 its width perpendicular to the channel width 66, so to say in the direction from the suction side wall 14 to the pressure side wall 10, is larger than the width of the bypass channel 54 in its opening region into the trailing edge channel 56 in the direction from the suction side wall 14 to the pressure side wall 10.

Inside the trailing edge channel 56 a plurality of pedestals 68 are located being surrounded by cooling air flowing through the trailing edge channel 56. The pedestals 68 are formed as round pillars connecting the pressure side wall 10 with the suction side wall 12 and transporting heat generated in the outer wall 8 into the trailing edge channel 56. The same type of pedestals 68 are located inside the serpentine channel 50 and a downstream section of the bypass channel 54, the downstream section extending about ⅔ of the total length of the bypass channel 54, whereby the number of pedestals 68 per area may be the same in the bypass channel 54 and the trailing edge channel 56.

Both cooling air channel systems 26, 28 supply outlets 38, 40, 42, 70 in the tip 24 with cooling air, however, the channel system 26 supplies only the outlets 38, 40, 42 in the tip 24 and the channel system 28 supplies at least one air outlet 70 in the tip 24 and at least one air outlet 62 at the trailing edge of the airfoil 4. The arrangement of the air outlets 38, 40, 42, 70 in the tip 24 are seen best in FIG. 3.

FIG. 3 shows the tip 24 of the airfoil 2 in a top view. The tip 24 comprises a rib 72 or protruding wall forming the radial outermost section of the outer wall 8, running completely around the floor 36 of the tip 24, and preferably rising 1%-2% of the length of the blade 2 or 2%-3% of the length of the air foil 4 above the floor 36. The floor 36 contains the outlets 38, 40 and a dust outlet 74, the outlets 38 forming a first group and the outlets 40 forming a second group. The first group of outlets 38 is arranged on the leading edge 16 and in a leading edge section 76 of the tip 24, called leading edge of the top of the tip 24 for convenience.

This section 76 extends from the leading edge 16 to an imaginary line shown in FIG. 3 being perpendicular to a skeleton line 80 of the blade 2 and cutting through the upstream surface or pressure side surface 10 of the airfoil 4. In the embodiment shown in FIG. 3 this section 76 extends in a distance towards the trailing edge 18 which is 1/10 of the distance between the leading edge 16 and the trailing edge 18. The second group of outlets 40 is arranged in a pressure side section 78 of the tip 24, called pressure side of the top of the tip 24 for convenience, extending from the pressure side wall 10 to the skeleton line 80. Both group of outlets 38, 40 are fed by the first cooling air channel system 26.

The first group of outlets 38 is formed by three holes in the floor 36 all arranged directly adjacent the rib 72. The second group of outlets 40 is formed by five holes in the floor 36 all arranged directly adjacent the rib 72 as well but with wider distances between the holes than in the first group of outlets 38. The holes of the first group all have the same diameter which is smaller than the diameter of the holes of the second group. The distances of the outlets 40 to each other are not equal. The distances of the middle outlet 40 to its neighbouring outlets 40 are larger than the distances of the outermost outlets 40 of the group to their neighbour outlets 40.

Between both groups of outlets 38, 40 is an outlet free zone extending from the first group to the second group. This zone is larger—seen in the direction from the leading edge 16 to the trailing edge 18—than the diameter of the first group of outlets 38 and larger than the longest distance between holes of the second group of outlets 40.

In a trailing edge section 82 of the tip 24 extending from the trailing edge 18 to an imaginary line about 30% to the leading edge 16, as shown in FIG. 3, and being called trailing edge of the top of the tip 24 for convenience, the outlets 42, 70 are arranged. They are formed as slots or slits bordered directly by the rib 72 or protruding wall and pointing radially outward and being bevelled towards the trailing edge 18 by about 70° to the radial direction, whereby 0° is purely radial and 90° is parallel to the floor. Due to this bevelling both outlets 42, 70 are bordered radially by walls. The outlet 42 is bordered by the floor 36 and a wall 84 separating the first cooling channel system 26 from the second cooling channel system 28. The outlet 70 is bordered by the wall 84 and a wall 86 leading to the trailing edge end of the rib 72.

The invention claimed is:

1. A gas turbine blade, comprising:

a root;

an airfoil with a leading edge and a trailing edge, a radial outer tip, and a pressure side and a suction side between the leading edge and the trailing edge; and a cooling air channel system extending from an air inlet opening in the root throughout the airfoil to a plurality of air outlets at the pressure side and the leading edge of the top of the tip of the airfoil, wherein a number of air outlets per area near the leading edge of the tip is higher than the average number of air outlets per area in the top of the tip, wherein a concentration of air outlets at the top of the tip of the airfoil is higher on the pressure side than on the suction side, and wherein the plurality of air outlets closest to the trailing edge are larger in air cross section than the plurality of air outlets in the middle between the leading edge and the trailing edge.

2. The gas turbine blade according to claim 1, wherein the plurality of air outlets at the leading edge form a group of air outlets arranged at the leading edge of the tip.

3. The gas turbine blade according to claim 2, wherein the shortest distance between the group and an air outlet on the pressure side closest to the group is larger than the diameter of the group.

4. The gas turbine blade according to claim 1, wherein the plurality of air outlets at the pressure side of the top of the tip are arranged in a row completely inside a rib at the pressure side of the tip leaving the thickness of the rib untouched.

5. The gas turbine blade according to claim 1, wherein the plurality of air outlets at the pressure side of the top of the tip are arranged in a row inside a rib, and wherein the distance between the plurality of air outlets in the middle between the leading edge and the trailing edge is larger than between the plurality of air outlets closer to the trailing edge.

6. The gas turbine blade according to claim 1, wherein the plurality of air outlets at the pressure side of the top of the tip are arranged in a row inside a rib, and wherein the distance between the air outlets in the middle between the leading edge and the trailing edge is larger than between the plurality of air outlets closer to the leading edge.

7. The gas turbine blade according to claim 1, wherein the plurality of air outlets at the top of the tip are arranged in a first section in a middle part of the pressure side of the tip and a second section at the trailing edge of the tip, and wherein the plurality of air outlets of the first section are formed different from the plurality of air outlets of the second section.

8. The gas turbine blade according claim 7, wherein the plurality of outlets of the second section point radially outward and are bevelled towards the trailing edge by 45° to 80° to the radial direction.

9. The gas turbine blade according claim 7, wherein the tip comprises a floor and a rib above and at least partly around the floor, the plurality of air outlets of the first section are holes in the floor, the floor ending on its way to the trailing edge, its end margin an air outlet of the second section formed as a slit.

10. The gas turbine blade according to claim 7, wherein the cooling air channel system contains at least two air channel systems, the first of which runs along the leading edge and the second one runs more distanced from the leading edge than the first one, the first channel system feeding the plurality of air outlets of the first section and being separated from an first air outlet of the second section, and the second channel system feeding a second air outlet of the second section and is separated from the plurality of air outlets of the first section.

11. The gas turbine blade according claim 10, wherein the first channel system feeds air only to the plurality of air outlets of the top of the tip, and the second channel system feeds air to the top of the tip and to the plurality of air outlets of the trailing edge between the tip and the root.

12. The gas turbine blade according to claim 7, wherein an air outlet of the tip arranged closest to the trailing edge is fed only by the second channel system.

13. The gas turbine blade according to claim 7, wherein the plurality of air outlets of the second section extend from the pressure side wall to the suction side wall of the top of the tip.

* * * * *